United States Patent [19]

Doan

[11] Patent Number: 4,807,397

[45] Date of Patent: Feb. 28, 1989

[54] COMPRESSION HONEYCOMB DOOR SEAL

[75] Inventor: Daniel C. Doan, Marietta, Ohio

[73] Assignee: RJF International Corporation, Akron, Ohio

[21] Appl. No.: 105,642

[22] Filed: Oct. 5, 1987

[51] Int. Cl.[4] ..... E06B 7/16

[52] U.S. Cl. ..... 49/498; 49/383

[58] Field of Search ..... 49/498, 497, 383

[56] References Cited

U.S. PATENT DOCUMENTS

| | | | |
|---|---|---|---|
| 2,622,286 | 12/1952 | Beck . | |
| 2,908,949 | 10/1959 | Frehse . | |
| 2,935,771 | 5/1960 | Hatcher, Jr. . | |
| 2,968,845 | 1/1961 | Dickinson | 49/497 X |
| 3,178,778 | 4/1965 | Reahard | 49/497 |
| 3,238,573 | 3/1966 | Pease, Jr. . | |
| 3,656,260 | 4/1972 | Weaver et al. . | |
| 3,690,037 | 9/1972 | Kempel . | |
| 3,952,455 | 4/1976 | McAlarney . | |
| 4,006,562 | 2/1977 | Belanger et al. . | |
| 4,381,115 | 4/1983 | Ko | 49/498 |
| 4,513,044 | 4/1985 | Shigeki et al. | 49/498 X |
| 4,658,548 | 4/1987 | Gerritsen . | |

FOREIGN PATENT DOCUMENTS

| | | |
|---|---|---|
| 711051 | 6/1965 | Canada . |
| 2401465 | 7/1975 | Fed. Rep. of Germany . |

*Primary Examiner*—Philip C. Kannan

*Attorney, Agent, or Firm*—Calfee, Halter & Griswold

[57] ABSTRACT

A honeycomb door seal for resiliently sealing a door to a surrounding structure has a semi-rigid base and a plurality of flexible enclosures. A central enclosure, capable of abutting a door, has an outer surface which is connected to a back side member of the seal through a plurality of ribs. A plurality of ribs generally form a common junction at the back side of the structure with each rib extending forwardly at an acute angle with respect to the door contact surface, i.e., the plane of the door. The remaining enclosures are arranged and shaped to provide good recovery and resiliency of the door seal. The seal can be made out of a flexible polymer such as a thermoplastic elastomer or a thermoplastic olefin.

4 Claims, 1 Drawing Sheet

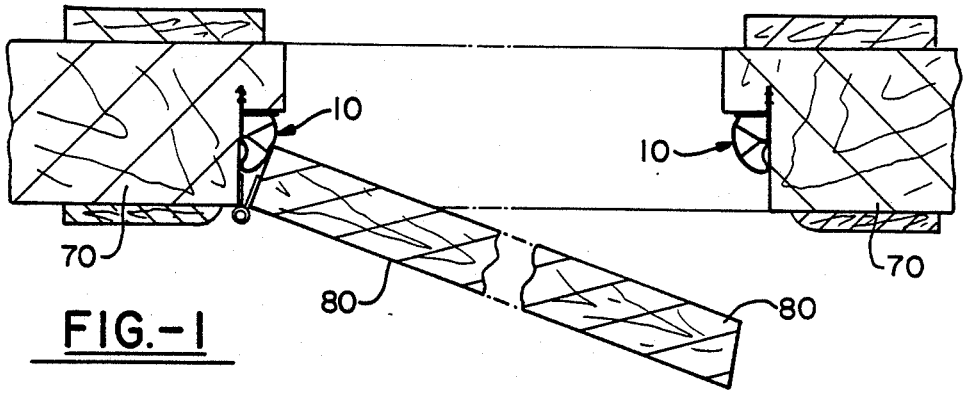
FIG.-1
FIG.-2
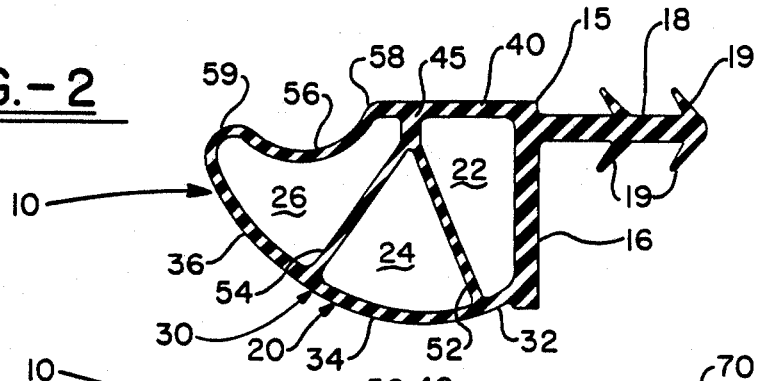
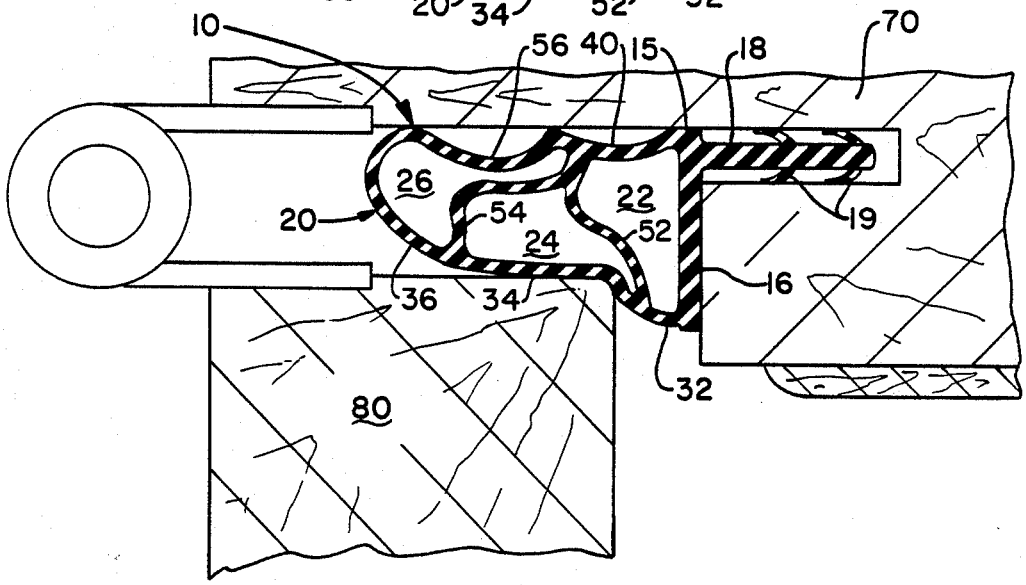
FIG.-3

COMPRESSION HONEYCOMB DOOR SEAL

FIELD OF THE INVENTION

The present invention relates to a compressible honeycomb door seal for use around the peripheral edge of a door for a building, refrigerator, etc., wherever it is desirable to obtain a hermetic and/or thermal seal. More specifically, the present invention relates to a honeycomb door seal which is readily compressible and yet retains adequate recovery over extended periods of time.

PRIOR ART

U.S. Pat. No. 2,622,286 to Beck relates to a trunk seal gasket which has a base portion, and an integral bulbous sealing portion with a lip extending therefrom.

U.S. Pat. No. 2,908,949 to Frehse relates to a honeycomb plastic door gasket in the form of a sealing strip having a plurality of hollow portions thereon.

U.S. Pat. No. 2,935,771 to Hatcher, relates to a sealing arrangement having a resilient sealing strip including a longitudinal base portion, a longitudinal tubular portion and a mounting means which includes a bar having a longitudinal groove therein to which the base portion of the strip is secured.

U.S. Pat. No. 3,238,573 to Pease relates to a weatherstrip for use with seal-faced doors or doors with magnetic edges.

U.S. Pat. No. 3,656,260 to Weaver et al relates to a weather seal having a rigid base and a soft-sealing flexible arm.

U.S. Pat. No. 3,690,037 to Kempel relates to a magnetic weatherstrip having a bellows located between the magnetic strip and a kerf.

U.S. Pat. No. 3,952,455 to McAlarney relates to a resilient, honeycomb gasket having a stiff base, an outer wall located over the stiff base, an oblong central cell extending from the base member to the outer wall and a pair of upward diverging arms connecting the central cell to the outer wall.

U.S. Pat. No. 4,006,562 to Belanger, et al, relates to a weather seal having a magnetic strip portion, a tail portion, and an intervening bellows portion.

U.S. Pat. No. 4,658,584 to Gerritsen rlates to a weatherstrip having a floating interior bulb.

Canadian Pat. No. 711,051 to Reahard relates to a nonslip door gasket having a large enclosure attached to a rigid base member.

German Offenlegungsschrift No. 2,401,465 relates to a weatherstrip having a single large enclosure for sealing one surface with a flange extending therefrom for sealing a second surface.

In spite of the above patents, there is still a need to provide a suitable honeycomb door seal which forms a good seal and yet has good recovery.

SUMMARY OF THE INVENTION

A resilient honeycomb door seal is designed against compression set. A plurality of enclosures or baffles trap air and provide reinforcement against flattening. The plurality of enclosures which are located in the honeycomb portion are attached to a rigid or a semi-rigid base portion generally made of a relatively hard or stiff thermoplastic elastomer or a thermoplastic olefin. The honeycomb is capable of abutting or contacting a door as through a central enclosure which has a front curvilinear surface. A plurality of ribs extend from the curvilinear surface and form a junction at the back side of the door seal. The ribs forming the central enclosure extend at an acute angle to the plane of the door surface contacting the honeycomb seal and provide reinforcement and resiliency to the door contact surface. The remaining enclosures are designed to provide additional resiliency and good recovery, that is retention of the original door seal shape after the door is removed from the abutting relationship.

BRIEF DESCRIPTION OF THE DRAWINGS

The above aspects and advantages of the present invention will become apparent upon reading the following detailed description and upon reference to the drawings, in which:

FIG. 1 is a top elevation cross-section view showing the door seal of the present invention residing within a jamb of a surrounding structure;

FIG. 2 is an end elevation cross-section view of the door seal of the present invention; and FIG. 3 is a top elevation cross-section view showing the door seal installed in the door jambs, with the door abutting the front surface thereof.

DETAILED DESCRIPTION OF THE INVENTION

The door seal or compressible weatherstripping of the present invention is generally indicated by the numeral 10. The door seal has a base portion 15 and a honeycomb portion 20. Generally, the base portion is relatively rigid, that is rigid or semi-rigid whereas the honeycomb portion is pliable. These differences can be achieved by utilizing either a more rigid material for base 15 and/or making the base portion thicker than the honeycomb portion. Various polymers which can be utilized for the seal include thermoplastic materials such as homopolymers of vinyl chloride, copolymers of vinyl chloride and vinyl acetate, polyethylene, polypropylene, and the like. Various thermoplastic elastomers such as EPDM, polyurethane, and the like, can also be employed. A flexible thermoplastic is often utilized for the honeycomb portion such as a flexible polyvinyl chloride composition containing various compounding ingredients therein such as plasticizers, pigments, fillers, antioxidants and the like, all well known to the art and to the literature. The base portion can often be made from the same thermoplastic compounds except that they are modified so that they are stiffer or harder.

Base portion 15 contains base plate 16 and a push-in interior depending stem 18. The stem contains a plurality of elongated projections or barbs 19 which point toward the base plate at an acute angle and are integral with the stem. When the stem is inserted into a surrounding structure such as a door jamb kerf, the barbs prevent easy removal of the door seal. The length of the stem and number of barbs thereon is generally conventional and can be of any suitable length. As apparent from the drawings, the door seal base portion can be an integral entity. When door seal 10 is inserted into the kerf of the door jamb 70, base plate 16 is seated on the surface of the door jamb as shown in FIG. 3.

Honeycomb portion 20 is generally integral with base portion 15 and thus can be coextruded therewith. The honeycomb portion contains a plurality of enclosures, that is hollow areas, which not only provide insulation but also supply resiliency and recovery thereto. Since the honeycomb does not contain foam, it has the advantage of not absorbing water, i.e., wicking, which tends to cause deterioration of the seal. The front portion of the honeycomb is generally curvilinear or arcual, that is it generally presents an outward or forward extending surface for contact with door 80. Front surface face 30 can exist as one single continuous curve as shown in FIG. 2, or it can exist as a plurality of separate surfaces, that is having inflection points therein usually at a junction point with a rib. The front surface face in connection with a plurality of ribs typically form the various enclosures. The ribs generally extend to the back portion, that is the backside of the honeycomb. Although any number of enclosures can exist, according to the preferred embodiment of the present invention, an interior enclosure 22 located adjacent to the base plate, a central enclosure 24 located above the interior enclosure, and exterior enclosure 26 generally located above the central enclosure, are provided, see FIG. 2.

As noted above, the design and structure of the honeycomb portion containing the various enclosures are such to provide resiliency, reinforcement, and recovery of the honeycomb once door 80 has been removed from the front portion thereof. Accordingly, central enclosure 24 has a front surface 34 which abuts the door when the same is closed to form an effective seal through a central contact area, see FIGS. 1 and 3. Although the door preferably contacts the central enclosure, it is to be understood that alternatively it can contact the interior enclosure, the exterior enclosure, or a plurality of enclosures. Closing of the door will force central front surface 34 inward or backward in a manner as shown in FIG. 3. In order to provide for resiliency and recovery of front surface 34, a lower or interior rib 52 and an upper or exterior rib 54 is provided. Ribs 52 and 54 are so arranged so that they form an acute angle with regard to the plane of the door surface contacting the seal. That is, the ribs extend forwardly at an acute angle with regard to a line perpendicular to the door surface which contacts the front surface face of the honeycomb. In the embodiment shown in FIG. 1, the door plane or surface contacting the honeycomb seal is actually either end of the door. Preferably, ribs 52 and 54 which in part form the central enclosure, traverse the line perpendicular to the door contact surface. That is, rib 52 will extend interiorly at an acute angle to said perpendicular line whereas rib 54 will extend exteriorly at an acute angle to the perpendicular line. Moreover, ribs 52 and 54 generally meet a common junction, vicinity or apex at the backside of the honeycomb. More specifically, the honeycomb portion has a backside member 40 which extends exteriorly from base plate 16 at the back portion of the base plate, as shown in FIG. 2. The backside member contains a flange or projection 45 thereon which is desirably located behind central front surface 34. The flange as well as backside member 40 are generally thicker or form a more rigid structure than do interior rib 52 and exterior rib 54. The junction, apex, etc., of ribs 52 and 54 is preferably with the backside flange. Hence, central enclosure 24 is bounded by front central surface 34, interior rib 52 and exterior rib 54. The optimum location of the junction is directly behind or back of the outermost portion of the front surface face. Inasmuch as honeycomb portion 20 is made of a resilient flexible material, closure of door 80 will form a contact area, preferably with front central surface 34 thereby creating a good weather seal. Upon removal of the door as by opening thereof, the resiliency of the front surface face as well as the structural arrangement of upper and lower rib 52 will force front surface face 30 and especially central front surface 34 thereof forwardly to its original shape. In essence, the interior and exterior ribs act as reinforcement or springs and aid in recovery of the front surface face.

Although the acute angles formed by interior rib 52 and exterior rib 54 with the perpendicular component of the door contact surface can vary, the acute angle with regard to exterior rib 54 is generally from 20 to 50 degrees, desirably from 30 to 40 degrees and preferably about 35 degrees, and the acute angle of the interior lower rib is generally from about 10 to 40 degrees, desirably from about 20 to about 30 degrees, and preferably about 25 degrees.

Bottom enclosure 22 is formed by interior front surface 32, interior rib 52, back side flange 45, back side member 40 and base plate 16. Desirably, front interior surface 32 is comparatively short in relationship to front central surface 34. This is so that upon contact of door 80 with the door seal as through front face 34, resiliency and/or reinforcement is imparted to the front surface face since lower interior face 32 tends to anchor the front surface face and prevent any extensive travel or give thereof, especially in association with interior rib 52. Enclosure 22 also provides another insulation pocket.

Exterior enclosure 26 is formed by exterior rib 54, front exterior surface 36, back or backside rib 56, and back side flange 45. The purpose of the top enclosure, in addition to forming an additional insulation area, is to permit a relatively small amount of free play in the door seal so that upon contact of the door with the seal, a contact area or plane along front surface face 34 is created. An additional reinforcement against the door is also provided. By providing such additional reinforcement, the general resiliency of the honeycomb portion of the door seal is maintained. In order to provide such additional reinforcement, back side rib 56 is generally curvilinear or arcual in a forward direction, that is in a direction towards the front of the seal. Upon contact of the door with seal 10, arcual portion 56 tends to act as a hinge thereby permitting the upper portion of exterior enclosure 26 to pivot thereabout and contact the door jamb.

The arcual portion of backside rib 56 is generally shallow, that is it has a large radius or curvature, since it is desirably located close to the door jamb to allow it to contact or seat on the jamb. Due to the force applied by the door to seal 10, it becomes contorted in a manner as shown in FIG. 3 and generally results in the plurality of contact points of the seal with the back portion of the jamb as shown in FIG. 3, that is, base 58 of the back side rib and top portion 59 of exterior enclosure 26. Thus, as should be apparent from FIG. 3, the exterior enclosure of the honeycomb imparts additional resiliency to the overall honeycomb portion of seal 10 when the door bears against it. Yet upon removal of the door, the resilient compressed nature of the exterior portion acts as a spring to return front seal face 30 into its generally curvilinear, forward projection.

Door seal or weather stripping 10 of the present invention can be installed in any suitable channel or kerf of a door jamb or the like by forcing stem 18 into the channel. Stem barbs 19 will tend to ensure a snug fit as well as to prevent removal of the door seal. Backside member 40 of the honeycomb portion will generally be flush against the door jamb with back side rib 56 and top portion 59 of the exterior enclosure being spaced apart a slight or small distance from the door jamb. Front surface face 30 is generally curvilinear and extends forwardly to provide a central contact area for engagement with a door about the periphery thereof. Once the door has been closed, it initially contacts front curvilinear surface face 30, especially along front central surface 34 of central enclosure 24. Upon further closure of the door to a normally closed position, the plurality of enclosures are contorted, bent and pressed, into a distorted configuration whereby resiliency is applied along the front surface face against the door forming an effective seal. Due to the design and structure of the seal of the present invention, it has adequate recovery. As noted above, a plurality of factors contribute to such recovery. For example, interior front surface 32 in having a short length provides limited backward movement of the front face. Exterior rib 54 and interior rib 52 which desirably traverse a line perpendicular to the intial door contact surface provides an abutting resiliency and essentially acts as springs. That is, since the interior and exterior ribs meet at a common junction or apex, a reactive force is applied to the front seal face 30 to return it to its original position. The curvilinear or arcual portion of back side rib 56 tends to create a springy hinge permitting the exterior enclosure 26 to pivot backward and contact the door jamb after a relatively short travel distance. The short travel distance permits an effective central contact or seal to be created between the door and the front seal face along an extended area before additional resiliency is created by the contact of top portion 59 of exterior enclosure 26 with the door jamb. The net result is the creation of an effective hermetic and/or thermal seal which is protected against compression set.

While the present invention has been described in detail, various embodiments, modifications, and the like can be achieved without departing from the spirit of the present invention. Accordingly, the scope of the present invention is set forth by the attached claims.

What is claimed is:

1. A thermoplastic compressible honeycomb door seal capable of use with a door and a door surrounding structure, comprising:

a relatively rigid base portion having a base plate, said base plate having a first distal portion and a second distal portion;

a compressible, flexible honeycomb sealing portion capable of providing a resilient door seal, having a plurality of enclosures and a curvilinear front contact surface face capable of contacting a door end surface, said curvilinear front contact surface face including a first front surface, a second front surface, and a third front surface;

a resilient backside member which extends substantially perpendicular from the first distal portion of the base plate;

said enclosures including an interior enclosure, a central enclosure and an exterior enclosure;

said central enclosure being formed by a first rib, a second rib, and the second front surface, said first rib traversing a line perpendicular to a line tangent to said contact surface face at an acute interior angle to the perpendicular line and thus being an interior rib, said second rib traversing the perpendicular line at an acute exterior angle to the perpendicular line and thus being an exterior rib, said first and second ribs being joined together and forming a common junction located in the vicinity of said backside member;

said interior enclosure being formed by the interior rib, the base portion and the first front surface, said front surface being short to provide for a limited backward movement of the front curvilinear surface face;

said exterior enclosure being formed by the exterior rib, the third front surface, and a backside rib, said backside rib being joined to said backside member and having a curvilinear portion therein, said exterior enclosure being capable of hingedly bending backward and contacting said door surrounding structure to permit a plurality of contact points of the seal with said structure.

2. A thermoplastic compressible honeycomb door seal according to claim 1, wherein said exterior enclosure pivots backward and contacts said structure after a relatively short travel distance.

3. A thermoplastic compressible honeycomb door seal according to claim 1, wherein said back side member is connected to said base plate, wherein said back side member has a flange, said common rib junction located on said back side flange.

4. A door and a surrounding structure, said surrounding structure having the compressible honeycomb door seal structure of claim 1 applied thereto.

* * * * *